United States Patent [19]

Haug

[11] 4,437,405

[45] Mar. 20, 1984

[54] APPARATUS FOR TRANSFERRING INK TO THE INK PLATE OF A METERING MACHINE

[75] Inventor: Werner Haug, Langnau, Switzerland

[73] Assignee: Frama AG, Switzerland

[21] Appl. No.: 366,179

[22] Filed: Apr. 7, 1982

[30] Foreign Application Priority Data

Apr. 30, 1981 [CH] Switzerland ..... 2838/81

[51] Int. Cl.[3] ..... B41F 31/00

[52] U.S. Cl. ..... 101/349; 101/329

[58] Field of Search ..... 101/348, 349, 353, 359, 101/36, 329, 324, 331, 101, 205, 206, 207, 324, 327, 331, 350, 367, 71, 352

[56] References Cited

U.S. PATENT DOCUMENTS

| | | | |
|---|---|---|---|
| 209,763 | 11/1878 | Keeler | 101/329 |
| 323,799 | 8/1885 | Ethridge | 101/237 X |
| 1,018,886 | 2/1912 | Dodge | 101/331 |
| 2,228,306 | 1/1941 | Ford | 101/352 |
| 3,759,178 | 9/1973 | Franchinot et al. | 101/349 |
| 4,051,781 | 10/1977 | Nishikawa | 101/348 |
| 4,121,521 | 10/1978 | Gill | 101/348 |
| 4,227,457 | 10/1980 | Hamisch, Jr. | 101/350 |

FOREIGN PATENT DOCUMENTS

| | | | |
|---|---|---|---|
| 1049354 | 12/1953 | France | 101/327 |
| 2071811 | 9/1981 | United Kingdom . | |

*Primary Examiner*—Edgar S. Burr
*Assistant Examiner*—John A. Weresh
*Attorney, Agent, or Firm*—McGlew and Tuttle

[57] ABSTRACT

An apparatus for transferring ink to the printing plate of a metering head of a metering machine has an ink storage roller mounted on a roller support with which it is interchangeably inserted through a lateral opening in the metering machine casing. On one end of the roller support, a handle is provided which is located laterally on the casing, thereby preventing contact with the ink storage roller during replacement. The insertion of a new ink storage roller is facilitated by a fixed bearing bolt on which is mounted the hollow shaft of the roller support. A protective sleeve connected to the back of the casing wall prevents unauthorized access to the metering head of the metering machine through the casing opening.

3 Claims, 5 Drawing Figures

APPARATUS FOR TRANSFERRING INK TO THE INK PLATE OF A METERING MACHINE

FIELD AND BACKGROUND OF THE INVENTION

The present invention relates in general to metering machines and in particular to a new and useful apparatus for transferring ink to the plate of the printing or franking head of a metering or franking machine with an interchangeable ink storage roller and at least one ink transfer roller.

In a commercially available, known apparatus of the aforementioned type, a journal is provided at each end of the ink storage roller, which can be placed at right angles to the roller's longitudinal direction, through a window in a casing part of the metering machine.

Replacement of the roller, however, is difficult, because contact with the ink by the hand is unavoidable. Additional contact may take place at the time of distributing, filing, packing, throwing away, etc. of the roller, so that soiling of the hands with ink cannot be prevented. In addition, the sequence of operations is mechanically complicated.

Such metering machines include postage meters and the like.

SUMMARY OF THE INVENTION

An object of the present invention is to provide an improved apparatus in which the ink storage roller can be replaced simply, rapidly and without any danger of an undesired ink transfer.

Accordingly, an object of the invention is to provide an apparatus for transferring ink to a metering head of a metering machine having a casing surrounding the metering head, comprising, the casing having a side wall with an opening therethrough, a fixed bearing bolt connected to the machine and extending in the casing, an interchangeable roller support having a hollow sleeve portion engageable through said opening and onto said bearing bolt, said support having a handle portion and an end thereof, an ink storage roller rotatably mounted to said hollow shaft portion of said support, said opening being large enough to permit the passing of said ink storage roller on said support, and locking means connected between the machine and said roller support for locking said roller support to the machine.

A further object of the invention is to provide a container for the interchangeable roller support with rotatably mounted ink storage roller which comprises a sleeve having a closed end with an axially extending bolt therein and locking means for receiving and locking the interchangeable roller support with a spent ink storage roller rotatably mounted thereon.

As a result of the construction according to the invention, it is possible to remove the ink storage roller with the roller support from a special packing container by means of a handle and, without changing, the roller can be placed into the metering machine. In the same way, the spent or used ink storage roller can be placed into the packing container that held the new roller but which has now become empty, so that the old roller can be thrown away with the packing container without any risk of undesired ink transfer.

A further object of the invention is to provide an apparatus for transferring ink to the metering head of a metering machine which is simple in design, rugged in construction and economical to manufacture.

The various features of novelty which characterize the invention are pointed out with particularity in the claims annexed to and forming a part of this disclosure. For a better understanding of the invention, its operating advantages, and specific objects attained by its uses, reference is made to the accompanying drawings and descriptive matter in which preferred embodiments of the invention are illustrated.

DESCRIPTION OF THE PREFERRED EMBODIMENTS

Figure 1:
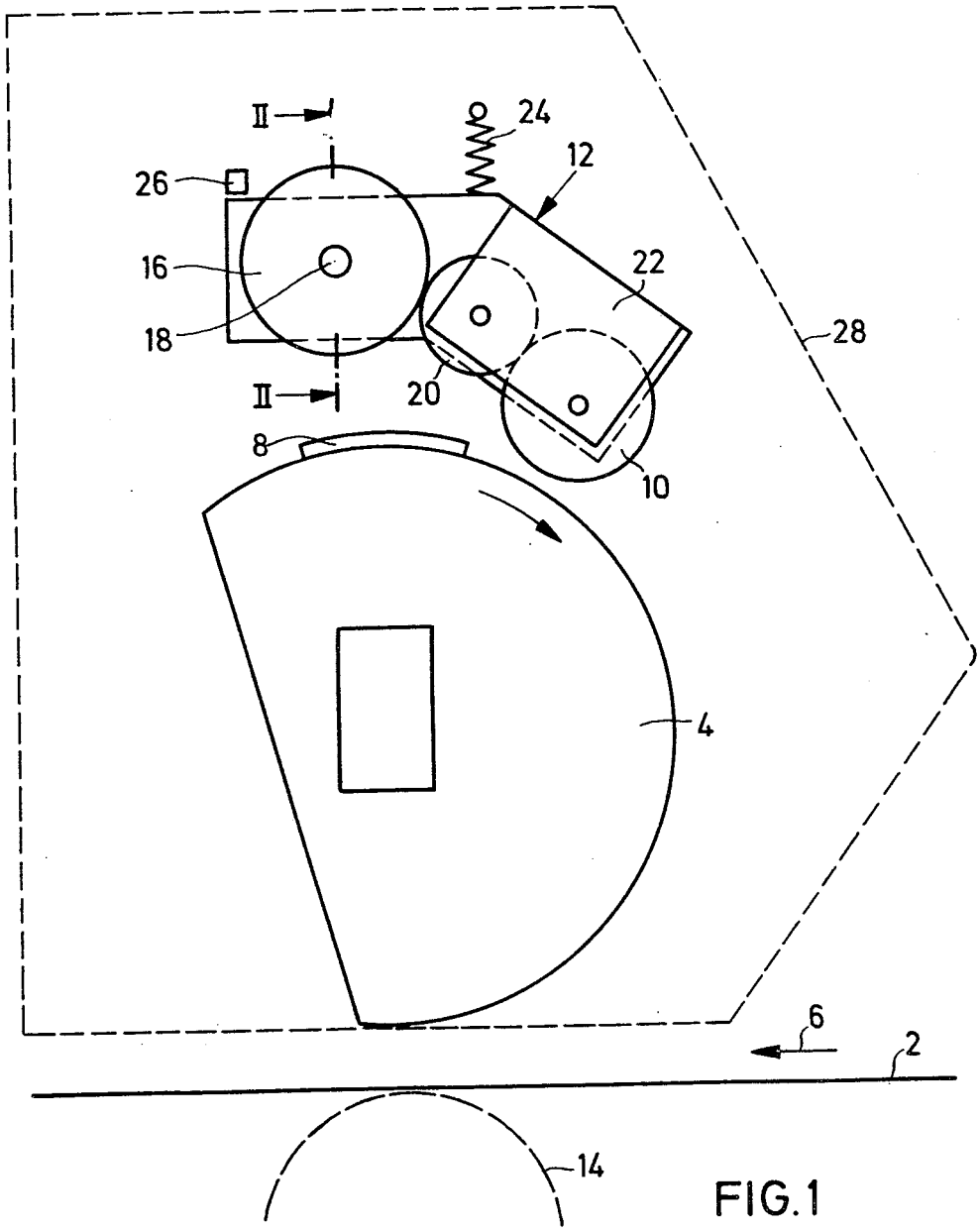
FIG. 1 is a diagrammatic side elevational view of a metering or franking machine in the vicinity of the printing head, and an ink transfer apparatus with the casing part removed, in accordance with the invention.

Referring to the drawings in particular, the invention embodied therein in FIG. 1, comprises a metering machine, whose general construction can be assumed as known, which has a metering or printing table 2 and a printing head 4 arranged above the table, laterally of a main casing (not shown) on which are provided the adjusting levers for adjusting a metering (e.g. postage) value. The printing head 4 rotates in accordance with the working cycle of the metering machine which is started by the insertion of an envelope in the direction of arrow 6, so that printing plate 8 rolls on the ink transfer roller 10 of apparatus 12 in the peripheral direction of printing or metering head 4, for the purpose of ink transfer and then on the surface of an envelope. The pressure is exerted by the automatic lifting movement of a pressure roller 14 indicated by a dotted line.

The ink storage roller 16 is made e.g. from foam and is impregnated with liquid ink. It rotates about a spindle 18, which is fixed with respect to the metering machine, and rolls on one of two ink transfer rollers 20, 10. The transfer rollers 20 and 10 are mounted in a frame 22 which is pivotable about a spindle, that is coaxial to the ink storage roller spindle 18, so that on contact with plate 8 the ink transfer roller is pivoted outwardly (counter clockwise) and radially away from the printing head 4. The pivoting movement takes place counter to the pressure of a spring 24. A stop 26 limits the swivelling movement of swivel frame 22 in the direction of the printing head (clockwise).

The metering head together with the ink transfer apparatus 12 are surrounded by a common casing 28, indicated by dotted lines, for safety reasons and to prevent an illicit adjustment of the set metering value on printing head 4.

Figure 2:
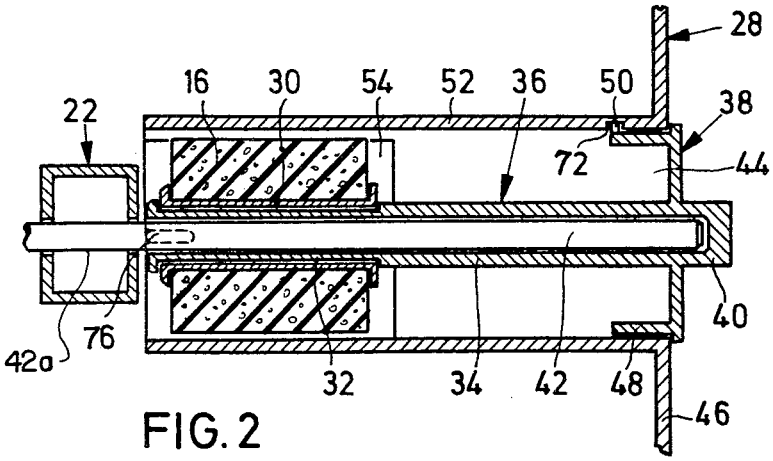
FIG. 2 is a sectional view taken along line II—II of FIG. 1, but with the casing part included and fitted into place.

The installation, i.e., mounting and fixing of ink transfer roller 16 can be understood from FIG. 2. Ink storage roller 16 is fixed to a bearing sleeve 30 which is rotatably mounted on a recessed part 32 of a hollow shaft 34 of a roller support 36. The ink storage roller 16 is located at one end of roller support 36, while at its other end is provided a centering and locking cap 38 with a web-shaped handle 40. In the fitted state hollow shaft 34 of the roller support is mounted on a bearing bolt 42 fixed to the meter machine. Swivel frame 22 is mounted on a bolt 42*a*. As a result, the roller support, with the ink storage roller can be placed in the metering machine by a simple sliding movement and can be removed again when the ink has been used up.

Figure 4:
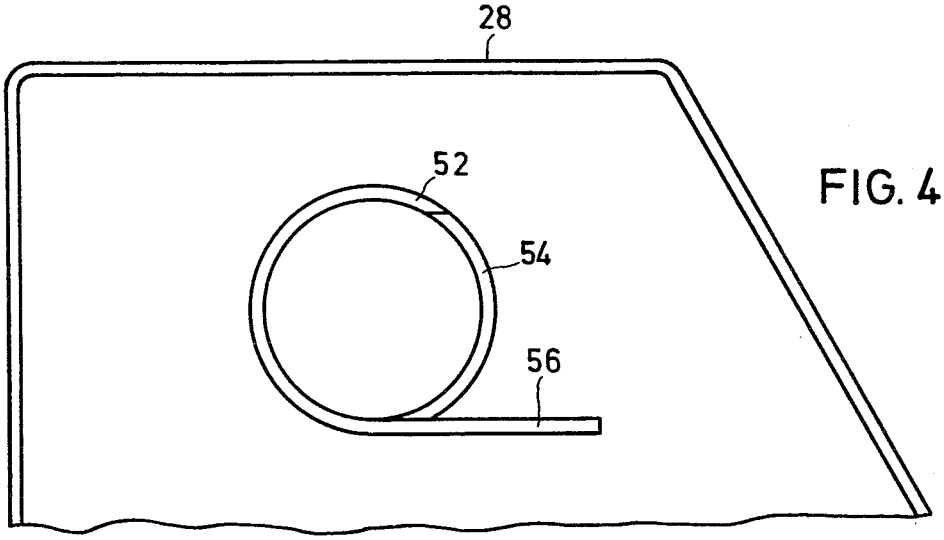
FIG. 4 is a partial interior view of the casing in the vicinity of the ink storage roller according to the invention.

Insertion takes place through an opening 44 in sidewall 46 of partial casing 28 of the metering machine which, in FIG. 1, runs parallel to the plane of the drawing. The size of opening 44 is the same as that of the external diameter of centering part 48 of centering cap 38, which can comprise individual, axially directed web parts. At one point on the centering part 48, there is a locking cam 50, which can be engaged in bayonet catch-like manner in a locking channel 72 of the casing part. Perpendicular to casing sidewall 46 a protective sleeve 52 passes into the inner area of the casing and surrounds, to the greatest possible extent, the roller support which the ink storage roller 16. The function of protective sleeve 52 is to prevent unauthorized access to the printing head 4 or to the plate 8, thereby permitting a change to be made to the metering value when the roller support and ink storage roller are removed. A lateral opening 54 in protective sleeve 52 permits contact between the ink storage roller and the adjacent ink transfer roller 20. The locking channel 72 for centering part 48 of the centering and locking cap 38 can have a rectangular course in the inner wall of protective sleeve 52, so that locking is brought about by a first axial displacement and a subsequent rotation of the roller support relative to casing 28. As can be gathered from FIG. 4, in the vicinity of opening 54, a wall part 56 is provided for preventing, access through opening 54 in the direction of printing or metering head 4.

The free end of bearing bolt 42 projects slightly beyond the outer surface of casing sidewall 46 so that, on inserting the ink storage roller through the opening 44 of casing part 28, centering of the insertion movement is brought about before there can be any contact between the ink storage roller and casing wall 46.

At the free end of hollow shaft 34 of the roller support, slots 76 are provided which permit a radial engagement when mounting the bearing sleeve 30 of the storage roller 16 during manufacture.

Figure 3:
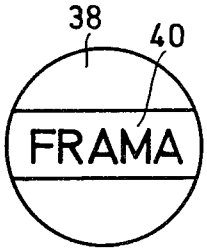
FIG. 3 is a handle side front elevational view of the roller support of the invention.
Figure 5:
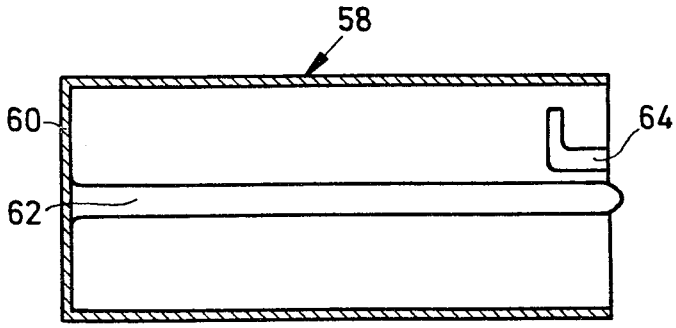
FIG. 5 is an axial sectional view taken through a packing container for the roller support with the ink storage of the inventive roller.

FIG. 5 shows a packing container 58, which can be used for supplying a new ink storage roller to replace a used or spent ink storage roller and which can be subsequently used for receiving the spent ink storage roller which has been removed from the metering machine, together with the roller support. The packing consists of a sleeve member on whose base wall 60 is shaped a guide shaft 62 which, on inserting the spent ink storage roller exercises the same function as bearing bolt 42 of the metering machine. Correspondingly, the free end of guide shaft 62 projects somewhat beyond the insertion opening of the sleeve. An angular slot 64 receives the locking cam 50 corresponding to the locking channel 72 in protective sleeve 52 according to FIG. 3.

While specific embodiments of the invention have been shown and described in detail to illustrate the application of the principles of the invention, it will be understood that the invention may be embodied otherwise without departing from such principles.

What is claimed is:

1. An apparatus for transferring ink to a metering head of a metering machine having a casing substantially surrounding the metering head, comprising:

the casing having a side wall with a side wall opening therein;

a fixed bearing bolt connected to the machine and extending in the casing;

an interchangeable roller support having a hollow shaft portion engaged through said side wall opening and coaxially onto said bearing bolt, said support having a handle portion and an end portion;

a protective sleeve having an inside diameter large enough to permit passage of said ink storage roller, connected to the casing side wall and extending into the machine from said casing side wall opening;

an ink storage roller rotatably mounted to said hollow shaft portion, said side wall opening being large enough to permit passage of said ink storage roller, said ink storage roller having an axial opening therethrough forming a bearing sleeve therein rotatably mounted on said hollow shaft portion;

at least one ink transfer roller mounted on a frame which is pivotable about an axle which is coaxial with said bearing bolt and being engaged with said ink storage roller, said protective sleeve extending over said ink storage roller and having a lateral opening for permitting contact between said ink storage roller and said ink transfer roller; and locking means connected between said casing and said interchangeable roller portion for locking said interchangeable roller support with ink storage roller thereon in said side wall opening.

2. An apparatus according to claim 1, wherein the casing has an outer surface adjacent said side wall opening, said bearing bolt having a free end projecting slightly beyond said outer surface of the casing side wall.

3. An apparatus according to claim 1, wherein said protective sleeve includes a wall extending from an edge of said lateral opening and positioned over the metering head of the metering machine to prevent access to the metering head through said casing side wall opening and said protective sleeve lateral opening.

* * * * *